US011111673B2

(12) United States Patent
Zeenni

(10) Patent No.: US 11,111,673 B2
(45) Date of Patent: Sep. 7, 2021

(54) VENTILATED REINFORCED-CONCRETE WALL MODULE FOR CONSTRUCTING BUILDINGS IN GENERAL AND RESPECTIVE INDUSTRIALIZED CONSTRUCTION SYSTEM

(71) Applicant: Zeenni Engenharia E Construcoes LTDA, Sao Paulo (BR)

(72) Inventor: Michel Fouad Zeenni, Sao Paulo (BR)

(73) Assignee: ZEENI Engenharia E Construcoes LTDA, Sao Paulo (BR)

( * ) Notice: Subject to any disclaimer, the term of this patent is extended or adjusted under 35 U.S.C. 154(b) by 0 days.

(21) Appl. No.: 16/626,629

(22) PCT Filed: Dec. 8, 2017

(86) PCT No.: PCT/BR2017/000142
§ 371 (c)(1),
(2) Date: Dec. 26, 2019

(87) PCT Pub. No.: WO2019/000059
PCT Pub. Date: Jan. 3, 2019

(65) Prior Publication Data

US 2020/0115898 A1 Apr. 16, 2020

(30) Foreign Application Priority Data

Jun. 27, 2017 (BR) ..... 102017013895-0

(51) Int. Cl.
*E04C 2/52* (2006.01)
*E04B 2/00* (2006.01)
(Continued)

(52) U.S. Cl.
CPC ..... *E04C 2/523* (2013.01); *E04B 2/00* (2013.01); *E04C 2/044* (2013.01); *E04C 2/06* (2013.01);
(Continued)

(58) Field of Classification Search
CPC . E04C 2/523; E04C 2/044; E04C 2/06; E04C 2/34; E04C 2002/045;
(Continued)

(56) References Cited

U.S. PATENT DOCUMENTS 3,885,008 A 5/1975 Martin
4,418,463 A * 12/1983 McNeill ..... B28B 23/028 140/112
(Continued)

FOREIGN PATENT DOCUMENTS

BR MU8702557 8/2009
BR PI0804170 7/2010
(Continued)

OTHER PUBLICATIONS

Machine translation of foreign reference FR2833285, obtained from https://translationportal.epo.org/emtp/translate/?ACTION=description-retrieval&COUNTRY=FR&ENGINE=google&FORMAT=docdb&KIND=A1&LOCALE=en_EP&NUMBER=2833285&SRCLANG=fr&TRGLANG=en (last accessed on Oct. 29, 2020) (Year: 2020).*
(Continued)

*Primary Examiner* — Theodore V Adamos
(74) *Attorney, Agent, or Firm* — Defillo & Associates; Evelyn A Defillo

(57) ABSTRACT

A ventilated wall module (10) of the type used in civil construction for a range of buildings using pre-fabricated components, such as one-story homes, large houses, houses, schools, hospitals, industrial sheds, inter alia; the wall module (10) includes a pair of panels (20A) and (30A) that are produced independently of one another by automated, robotic equipment (E1), based on large moving metal surfaces (M1) that slide on rails (T1); said mechanized method (M1) developed for the production of the panels (20A) and (30A) includes an industrialized construction system (SC)
(Continued)

for producing each wall module (10) comprising the combination of the coordination and compatibilization of the designs to be implemented with the pre-installation of the complementary components such as electrical boxes (c1) or other necessary elements.

2 Claims, 13 Drawing Sheets

(51) Int. Cl.
*E04C 2/04* (2006.01)
*E04C 2/06* (2006.01)
*E04C 2/34* (2006.01)
*E04C 2/00* (2006.01)

(52) U.S. Cl.
CPC ..... *E04C 2/34* (2013.01); *E04B 2103/02* (2013.01); *E04C 2002/002* (2013.01); *E04C 2002/045* (2013.01)

(58) Field of Classification Search
CPC ..... E04C 2002/048; E04C 5/122; E04C 2002/002; E04B 2/00; E04B 2/8617; E04B 1/3511; E04B 2103/02; E04G 15/04; E04G 21/14; E04G 21/142
See application file for complete search history.

(56) References Cited

U.S. PATENT DOCUMENTS 4,998,393 A * 3/1991 Baena ..... E04B 1/161 52/236.9
5,248,122 A * 9/1993 Graham ..... E04C 2/044 249/91
5,288,538 A * 2/1994 Spears ..... B29C 44/1228 428/116
6,282,860 B1 * 9/2001 Ramirez ..... E04C 5/167 52/677
2003/0033781 A1 * 2/2003 Schmidt ..... E04B 2/8617 52/426
2003/0183742 A1 10/2003 DeLoach
2007/0137133 A1 * 6/2007 Bartels ..... E04C 3/293 52/633
2008/0196349 A1 * 8/2008 Gonzalez ..... E04B 2/845 52/653.1
2020/0157806 A1 * 5/2020 Manisier ..... E04C 2/34

FOREIGN PATENT DOCUMENTS

BR PI0819422 5/2015
BR 112013008848 6/2016
CA 2573687 2/2008
FR 2324821 A1 * 4/1977 ..... E04C 2/044
FR 2833285 A1 * 6/2003 ..... E04G 21/145
FR 2857391 1/2005
KR 20070097891 10/2007
WO WO-03104577 A1 * 12/2003 ..... E04C 2/041

OTHER PUBLICATIONS

Machine translation of foreign reference FR232482a, obtained from https://translationportal.epo.org/emtp/translate/?ACTION=description-retrieval&COUNTRY=FR&ENGINE=google&FORMAT=docdb&KIND=A1&LOCALE=en_EP&NUMBER=2324821&SRCLANG=fr&TRGLANG=en (last accessed on Oct. 29, 2020) (Year: 2020).*

* cited by examiner

SECTION A.A
20A
41A
20b
20c
70
60
61
50
s1
s3
Q1
A
x1

SECTION B.B
50
50
41B
s2
s4

70
41B
30b
30A
30b
x2
30c
Q2
s4
41B
B
B
41B
30c
41B
Q2
s4
70
41B
30b
x2

FIG.2
DET.P1
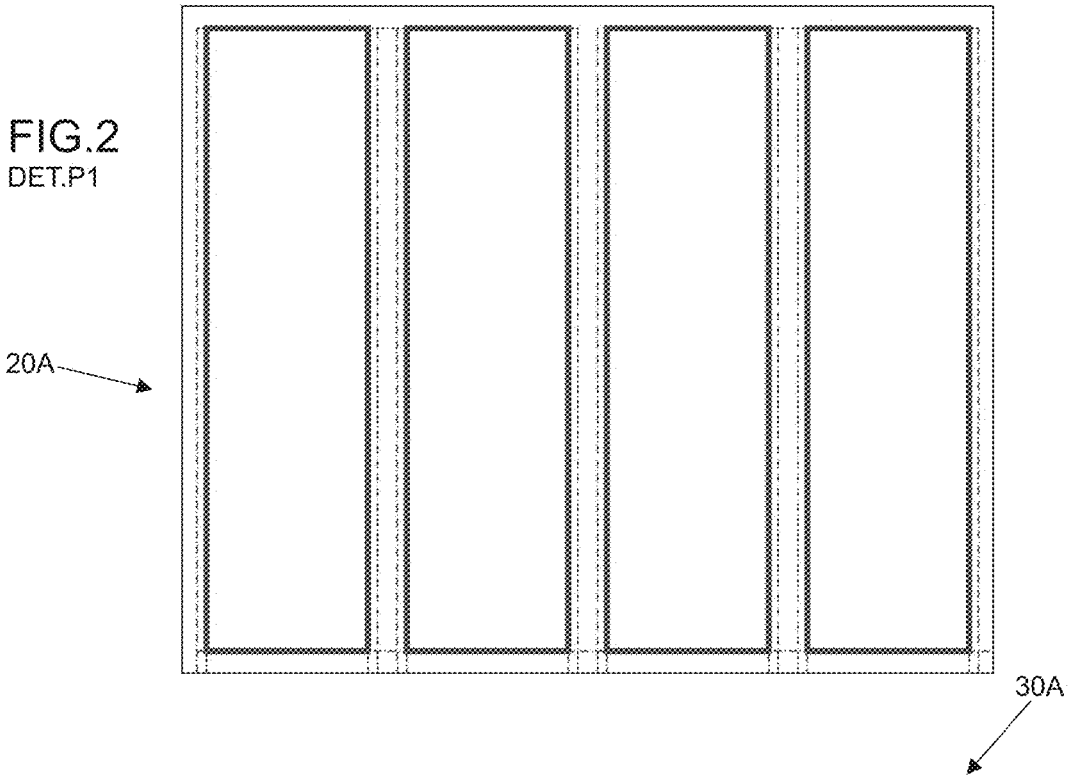
FIG.2A
DET.P1
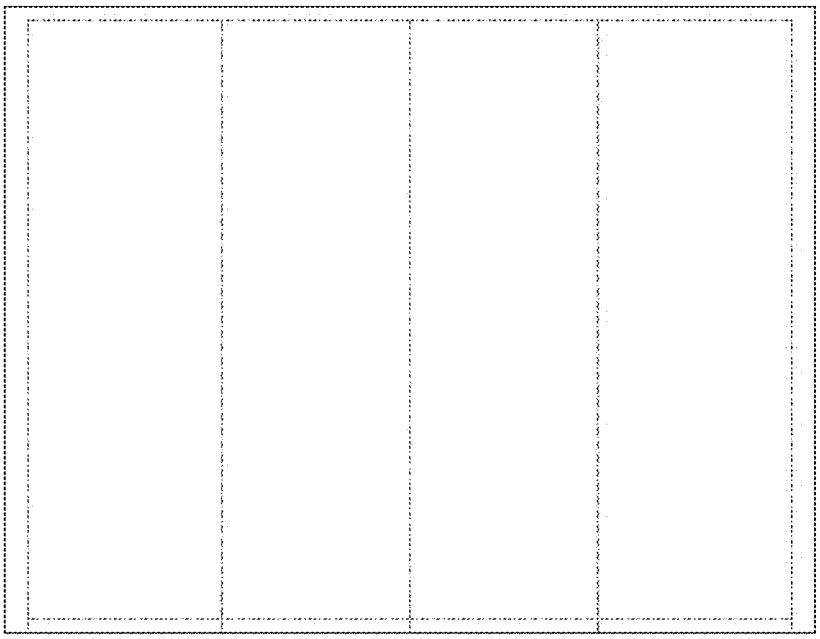
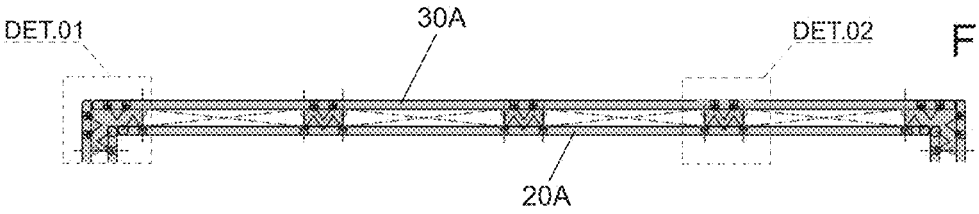
FIG.2B

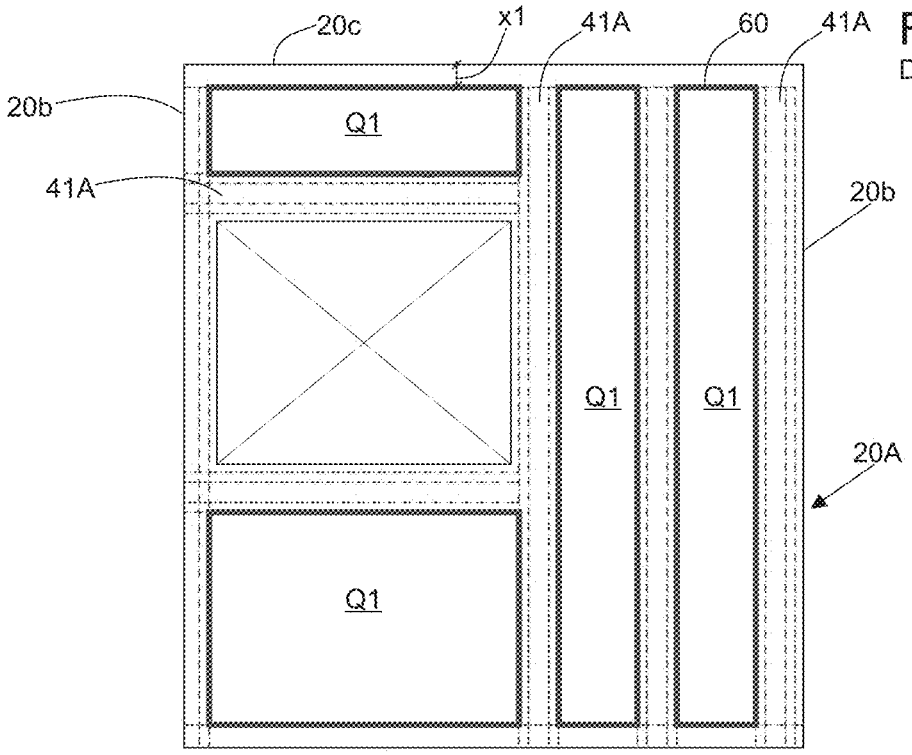
FIG.3
DET.P2
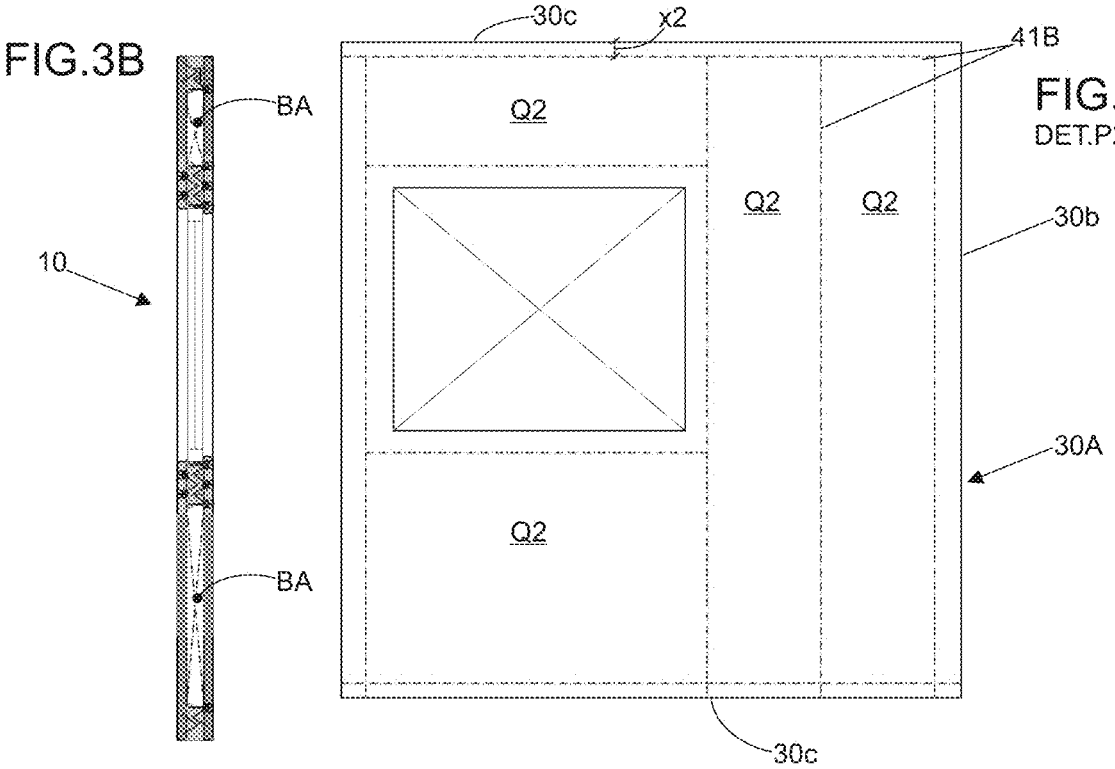
FIG.3A
DET.P2
FIG.3B
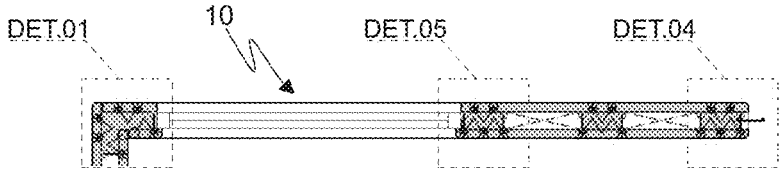
FIG.3C

SECTION C.C

DET.C

DET.D

VENTILATED REINFORCED-CONCRETE WALL MODULE FOR CONSTRUCTING BUILDINGS IN GENERAL AND RESPECTIVE INDUSTRIALIZED CONSTRUCTION SYSTEM

CROSS REFERENCE TO RELATED APPLICATION

This application is a national stage entry of PCT/BR2017/000142 filed Dec. 8, 2017, under the International Convention and claiming priority over Brazilian Patent Application No. BR102017013895-0 filed Jun. 27, 2017.

TECHNICAL FIELD

The present invention patent relates to improvements to a ventilated reinforced-concrete wall module for constructing buildings in general and respective industrialized construction system where, notably, the mentioned ventilated concrete wall module is formed by a pair of vertical panels, manufactured independently of each other, but interconnected by reinforced-concrete ribs with metal trusses, strategically positioned on the contact faces to ensure perfect solidarization, thus creating among them internal voids that facilitate the passage of electrical and hydraulic installations, in addition to create air pockets that provide thermal comfort and low humidity rate. Each pair of panels has an external surface with an architectural finishing or ready to be painted, in addition to being manufactured with variations in length, height, and width, depending on their application.

The innovative construction characteristics of the walls in question make up a triple function, which are: (i) structural, (ii) sealing and (iii) architectural, in addition to the construction system allow the execution of large quantities of works in less time, without waste of raw material and labor, obtaining a final product with high functional quality and finishing, at a controlled cost as planned.

TECHNICAL BACKGROUND

The civil construction market is always seeking improvements in operational activities to enable better speed, convenience, and economy in the construction processes of residences, commercial establishments, buildings, among others.

Therefore, the execution of constructions with structural elements in precast concrete such as columns, beams, slabs, among others, is being increasingly used due to some advantages that the product offers, and the vast majority of concrete elements are molded in an appropriate place out of its definitive position of use in construction so that they acquire a degree of strength, in order to enable proper assembly.

The main disadvantage of this type of structural element is the difficulty of locomotion of the load/unload and their movement to the construction disposal, because it is a solid block of concrete with iron reinforcements becomes heavy and the locomotion is performed only through specific machinery.

Other prefabricated structural element is formed by vertically-concreted walls with vertical metal forms and horizontally-concreted slabs, both produced on-site whose vertical and horizontal metal forms can be reused more often, and after their production the referred structural elements are transported and assembled at the building site. For the execution of the structures of these forms are produced to execute a type of wall in large quantity to amortize its cost, therefore there are limitations in the flexibility of the architecture, besides presenting low thermal comfort in very hot and very cold regions.

Other inconvenience is due to the form of concreting being vertical, allowing the occurrence of failures in the concreting that must be repaired after the dismounting, generating rework and, consequently, the increase in the number of skilled labor.

Other inconvenience lies in the fact that all connections require skilled labor in order to ensure perfect solidarization to avoid cracks with subsequent infiltration of water.

Other inconvenience lies in the fact that all installations of accessory parts, such as pipes, outlet boxes, and others must be foreseen before concreting, because, if it needs any change, the repair stages require costs and care not to undermine the structure.

Similarly, horizontally layered concrete walls are provided in the market, being one concrete layer, another layer of inert elements such as polystyrene, concrete blocks and finally concrete again which, in turn, receives the finish. After the concrete reaches the resistance, the referred walls are transported and assembled in the building.

The applicant, operating in the field of civil construction, is the holder of document n° MU8702557-4 dealing with prefabricated panel for industrial, commercial, and residential construction, and its construction processes are directed to production in industrial scale, enabling reduced manpower and low productive cost; the cementitious panel called 'prefabricated panel for civil construction' is made from reinforced concrete or any other material that meets the requirements compatible with its application, internally containing three equidistant internal rectangular spans, and in each of the spans are two rectangular holes are provided, one near the upper outer end, called the outer hole, and the other near the lower inner end, called the inner hole, both on the vertical central axis of the spans; the mentioned rectangular spans formed between the opposing cementitious plates and the air circulation established by the external hole and the internal hole provide great thermal and acoustic comfort to the environment formed by using the prefabricated panel for civil construction. These double walls with internal void have as their main attribute the thermal comfort; in addition, the concrete faces are turned outwards, providing a perfect finish without the need for skilled labor.

Despite all the above advantages already provided for in patent application MU8702557-4, this structural element still has a few drawbacks as, for example, due to the manufacturing system is based on conventional precast systems, it is necessary that each wall takes up two equally sized spaces and thus requires more manufacturing space.

Other inconvenience is that the concreting of each panel is performed on different days so that the solidarization takes place between a rigid piece (from the previous day) on the 'soft' piece (newly concreted) through steel and metal frames previously and strategically fixed in the rigid piece, and this point is, inclusive, one of the greatest differentials in relation to the improvement proposed herein.

Analysis of the State of the Art

Complementing the information on the state of the art, a survey carried out in specialized databases made it possible to know documents referring to prefabricated wall forming panels, such as document n° BR202014015765-0 which relates to prefabricated constructive panel applied in civil construction, in particular, in the construction of structural walls of buildings, aiming to minimize the use of labor and the generation of waste, shorter construction time and obtain walls with thermal and acoustic insulation, incombustible, through optimized project that generates constructive improvements through upper horizontal opening, lower horizontal opening, protrusions, and reinforcement layers.

Other document n° PI 9700932-6 refers to the frame to be used in the manufacture of prefabricated panels as well as prefabricated panel constructed or manufactured from it to be installed in buildings, and the referred frame is constituted by two meshes arranged in parallel planes, which are joined by "non-welded" separators, which are made up of hooks that present at their ends folds or throats, and in one of them are the bars that form one of the meshes and on the other the bars forming the other mesh, thereby fixing the meshes and forming a monoblock frame. The frame of the present invention can be completely filled by pouring light concrete into the mold at the factory itself, thus forming a complete (finished) finish panel, or stuffed only in the central core or panel core to thereby form an intermediate product.

Other document n° KR20070097891 relates to mortar precast concrete panel and a construction method thereof for carrying out a construction including a precast concrete panel, a reinforced wire and a wall structure. The concrete panel is formed by installing a plurality of concrete side walls formed inside with a support wire in parallel with each other. The reinforced wire attaches to both sides of the support wire, which is formed in the space of the concrete panel in a 'zigzag' manner.

The documents cited in the above paragraphs are cited only as state of the art and, therefore, do not present prior art in relation to the object improved herein, thus ensuring that it meets the legal requirements of patentability.

Invention Purposes

In order to improve the consumer market, the applicant developed improvements to a ventilated reinforced-concrete wall module for constructing buildings in general and respective industrialized construction system, in order to enable the construction of residences with one or more floors, as well as multi-storey buildings, schools, shopping malls, hospitals, shed closures, hotels, among others.

The aforementioned ventilated reinforced-concrete wall module is composed of a pair of vertical panels produced independently of each other and in reinforced concrete, but each pair of panels always adopting similar dimensions among them, varying only in function of the connections between panels in length, height, and thickness, and being interconnected during the manufacturing process of referred ventilated walls, by metal rib trusses and other components, strategically positioned to ensure perfect solidarization between the referred panels.

For the production of solidary panels, entirely automated and robotic equipment is used, based on large metal tables, magnetized metal shapes and automatic vibrators. The steps used for the production of panels can be carried out through the following sequence:

a) Application of the demolding agent in the clean metal table. Robotic equipment with movable metal tables is used in this stage, where the panels circulate towards the concrete plant that remains fixed or fixed forms of concrete where the concrete is taken to the concreting site;

b) Placement of 10 cm magnetized metal shapes obeying the project measures on the four sides of the panel, marking on the side of the shapes the maximum 3.5 cm of concreting of the final thickness of the panel. Repeat the same procedure in the case of doors and windows, where applicable;

c) Fixing the electrical boxes;

d) Frame on both sides with screens, trusses, lifting cables, cables for connections, vertical and horizontal, and cementitious plates fitted in the claw spacers;

e) Concreting with Fck 40 Mpa, both panels that form the wall, in compliance with performance standards;

f) After the curing time, approximately 8 hours in the curing chamber, or 12 hours without curing, the panels are removed and placed on the clothesline facing each other at a distance of 50 cm to allow placement of the electrical and hydraulic installations, if any;

g) Closing of two panels and grouting the ribs that have the lifting cables. After the grout curing, the wall is ready to be transported to the site for assembly.

Mentioned trusses of the ribs of each panel that form the ventilated wall module are mismatched with each other to ensure their superposition and the perfect joining of the panels after grouting.

The referred solidary panels that make up each wall module are produced simultaneously, horizontally and vertically solidarized, 'hard on hard', after the passage of the installations.

The arrangement of the pair of panels and their ribs composes a single plate of varied dimensions, for example, of 2.50 m×1.60 m, with interstitial span of 7 cm that facilitates the passage of electrical and hydraulic installations, in addition to creating air pockets that provide thermal comfort and low humidity rate.

At least two of the panel ribs, arranged near the corners, are equipped with lifting cables that are concreted in the factory, thus creating means that facilitate the movement of each wall module between the manufacturing process and the work site.

The ventilated wall module has only the ribs where there are the factory-built concreted lifting cables, leaving all the other ribs, when they exist, to be grouted after assembly in the work, thus ensuring a better guarantee of the full filling of the bottom beam of the wall.

The assembly of the solidary panels configures a reinforced-concrete ventilated wall module, whose external faces are the result of the mold used during processing, a mold that can have the smooth or textured surface, resulting in architectural finishing obtained during the process of obtaining each panel. Thus, the surface of the panel that was in contact with the metal table, after the end of the process, can receive, directly, a simply painting, or varied coatings, as the mold may have the characteristics of wood shafts, bricks, or other finishes.

The panel pairs may vary in length, height, and width depending on their use.

Thus, one of the main advantages of this invention lies in the fact that the stages of completion of the construction of each structural wall module are carried out on-site, in order to meet the construction market with an industrialized constructive system that enables builders to perform large quantities of works in a shorter time, without waste of raw material and labor, obtaining a final product with high functional quality and finishing, at a cost controlled accordingly with the planned mainly due to the decrease in the administrative technical supports that a conventional work requires.

This industrialized construction system is comprised by the association of coordination and compatibility of executive projects of architecture of buildings to be implemented with complementary projects; the means of development to meet the needs of the desired architecture for each environment is carried out by the system's engineering itself, since the architectural design is read by system and, when the above-mentioned step (f) of the manufacturing process of each ventilated wall module, the robotic automation establishes, through metal shapes on metal tables, all installations such as electrical, hydraulic, air conditioning and others.

With said industrialized construction system it is possible to build the most varied types of work, with great flexibility of use, adapting easily to different architectures, since the solution is fully incorporated into other forms of structure without prejudice to architecture.

An important advantage of the innovative ventilated wall module lies in the fact that it presents itself with both sides of the module fully finished and/or ready to receive the coating of paints, ceramics or others.

The assembly of wall modules for the obtaining of the building is simple, with very low risks of work accident, and already with the productivity that the system requires, since the final quality of the product does not depend on the qualification of this workforce.

Other advantage lies in the fact that the interstitial span of the structural wall generates thermal comfort with low humidity rate, as well as facilitates passages of electrical and hydraulic installations.

Other advantage lies in the fact that the horizontal, upper, and lower belts are grouted on site to ensure perfect connection between walls and slabs.

Other advantage lies in the fact that buildings with various floors the ribs of the ends of the walls and intermediates that are not grouted in the factory, have vertical iron bars ensuring the connection between the floors.

Other advantage lies in the fact that the wall allows the assembly of independent parts consisting of corner connection ribs, intermediate, connection between walls and end ensuring a perfect connection between all parts, as well as the existing voids function as a preform of built-in beams and pillars.

This innovative wall presents other significant advantages, such as:

Industrial control with traceability and testing of applied materials;

Application of materials and finishes in a controlled environment providing a final product with quality and with full traceability of concrete resistance avoiding defects after its application;

Reduction of deadlines such as manufacturing speed, production line, better working condition;

Quantity of materials and labor consumption per activity, controlled due to industrial processes;

Finishes performed on the production line with less climatic interference;

Lighter parts due to interstitial spans, as well as low average thickness of concrete and materials, when compared to other systems;

Structural safety, because when there is a low result at 28 days in the tests the compression and the wall in question is already mounted, the structural reinforcement, if necessary, passes through the simple concrete filling of the existing voids by a small hole, thus to bend the concrete area and, consequently, the load capacity;

Reduction of administrative expenses of the works, with the reduction of labor and the time of execution of the work, specifically, technical supervision by qualified professionals, provisional facilities for the use of local labor in compliance with the labor laws such as bathrooms, changing rooms, cafeteria, marmite or kitchen, etc., water, electricity, etc.

Significant reduction of transport with inputs, personnel, and leftovers/rubble, when compared to conventional works;

This structural wall also has as main attribute the total flexibility of use, as application in single homes, houses or buildings with unlimited height and due to the high finish can be used in popular products and very high standard, as well as hotels, office buildings, schools, hospitals, industrial sheds, among others.

DESCRIPTION OF THE DRAWINGS

To complement this description in order to obtain a better understanding of the characteristics of this invention and in accordance with a preference for its practical implementation, it accompanies the description attached, of a set of drawings in which, in an exemplary but not imitative manner, its operation has been represented:

FIG. 2 shows a front view of a panel that comprises a ventilated wall module applied to the previous figure;

FIG. 2A shows a frontal view of another panel that comprises a ventilated wall module applied to the previous figure;

FIG. 2B reveals a top view of the module illustrated in the previous figure, revealing the solidarization elements;

FIG. 3 shows a frontal view of a panel that comprises a ventilated wall module applied to the FIG. 1;

FIG. 3A show frontal view another panel that comprises a ventilated wall module applied to the FIG. 1;

FIG. 3B shows a longitudinal section view of the ventilated wall module illustrated in the previous figure;

FIG. 3C shows a top view of the ventilated wall module illustrated in the previous figure;

DETAILED DESCRIPTION OF THE OBJECT

With reference to the illustrated drawings, the present invention patent refers to the "IMPROVEMENTS TO A VENTILATED REINFORCED-CONCRETE WALL MODULE FOR CONSTRUCTING BUILDINGS IN GENERAL AND RESPECTIVE INDUSTRIALIZED CONSTRUCTION SYSTEM", more precisely, it is a ventilated wall module (10) of the type used in civil construction of various buildings using prefabricated parts such as single story houses, townhouses, buildings, schools, hospitals, industrial warehouses, among others. The aforementioned wall module (10) comprises a pair of panels (20A) and (30A) that are produced independently of each other by automated and robotized equipment (E1), based on large mobile metal tables (M1) that slide on rails (T1) strategically positioned in the plant, metal tables (M1) that receive demolding agent in the upper surface, as well as the distribution of magnetized metal shapes (F1), properly positioned by robots according to the architectural design of each panel (20A) or (30A) to be manufactured; the equipment (EI) also includes automatic vibrating mechanisms (VI) that produce the accommodation of the concreting dispensed by the concrete plant (UI).

Figure 1A:
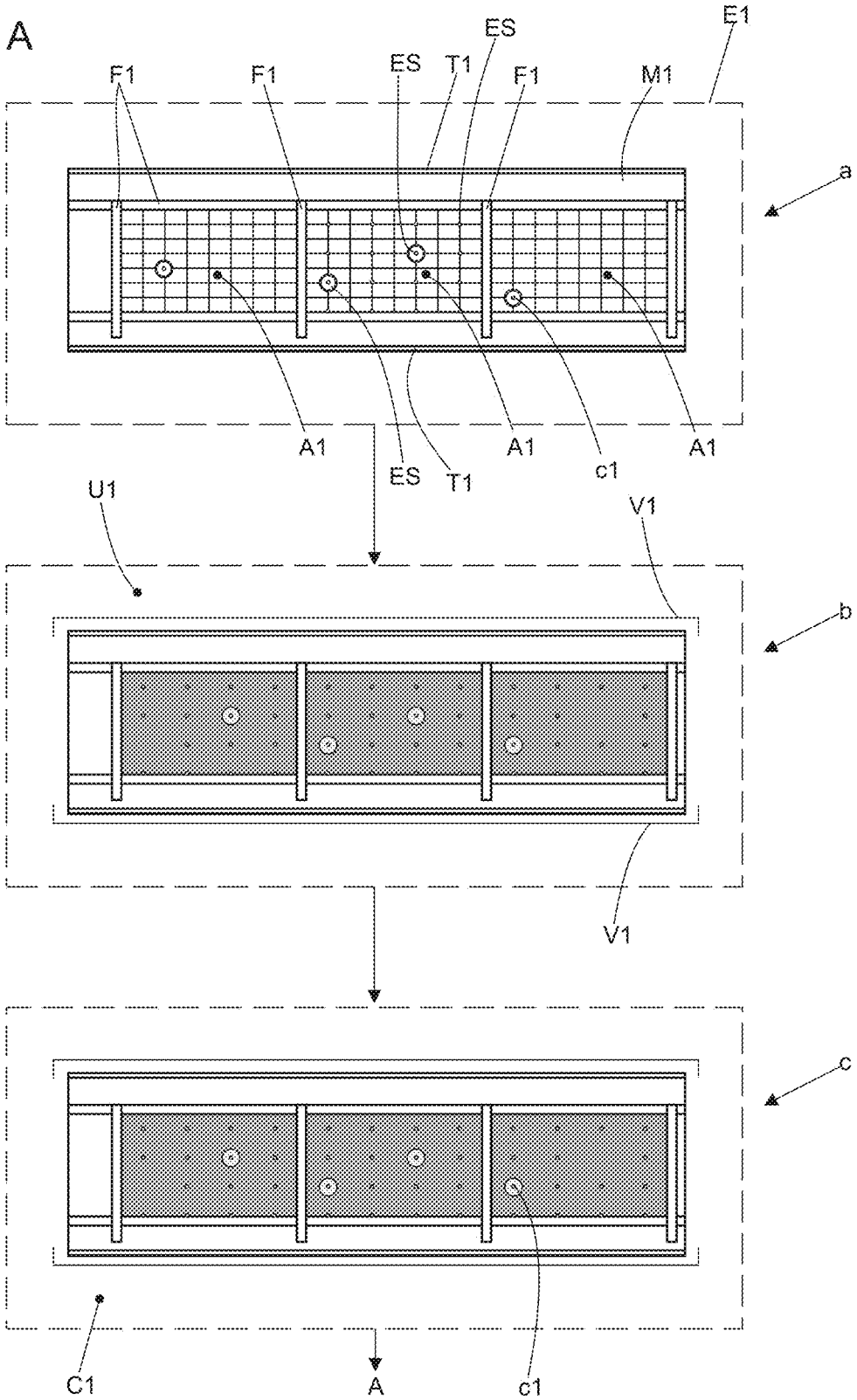
FIG. 1A represents a schematic view of the steps of the mechanized method developed for the production of panels.
Figures 1B, 1C:
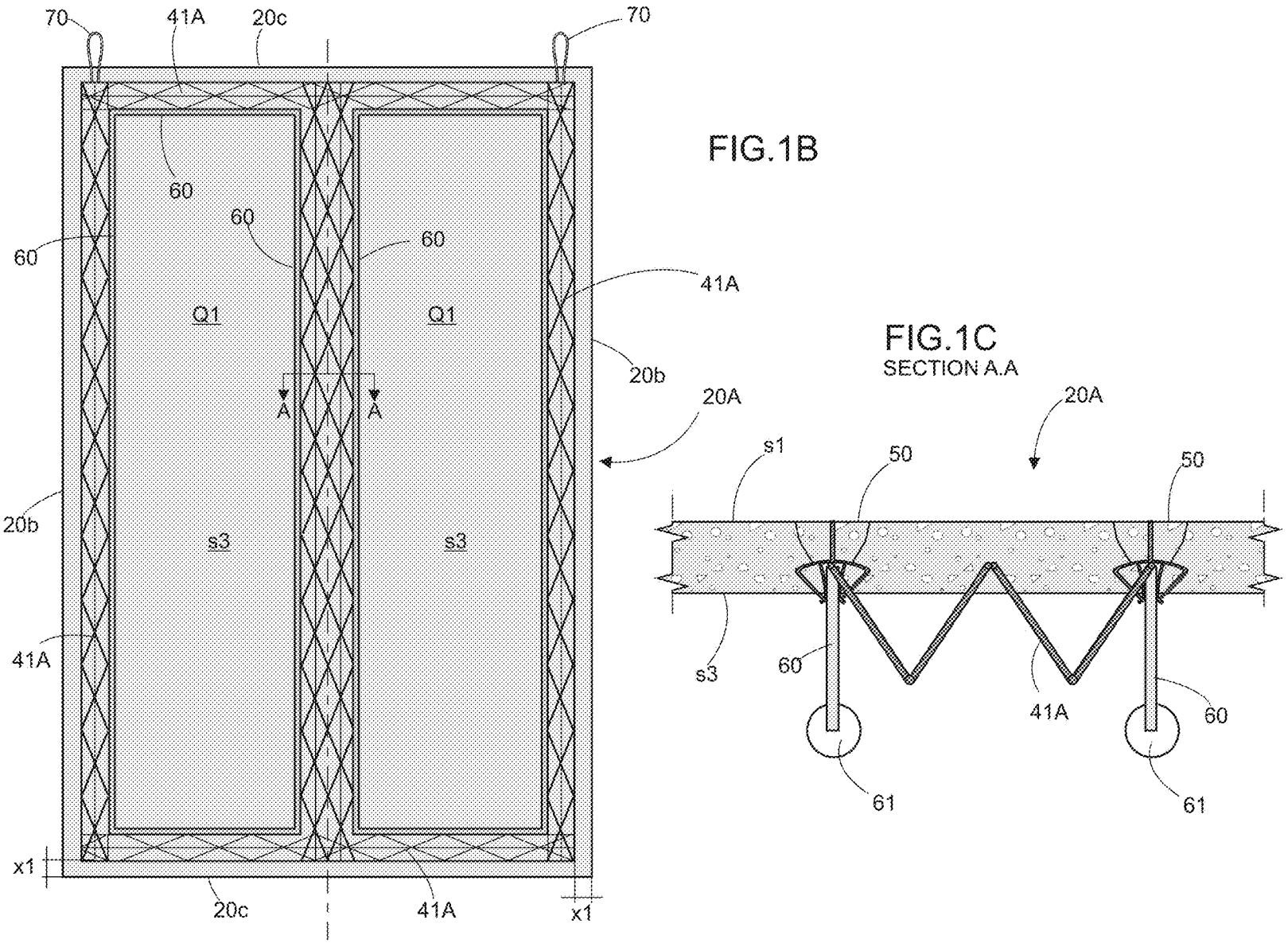
FIG. 1B shows a frontal view of the panels of FIG. 1.
FIG. 1C shows a cross sectional view of the panel taken along Line AA on FIG. 1B.
Figures 1D, 1E:
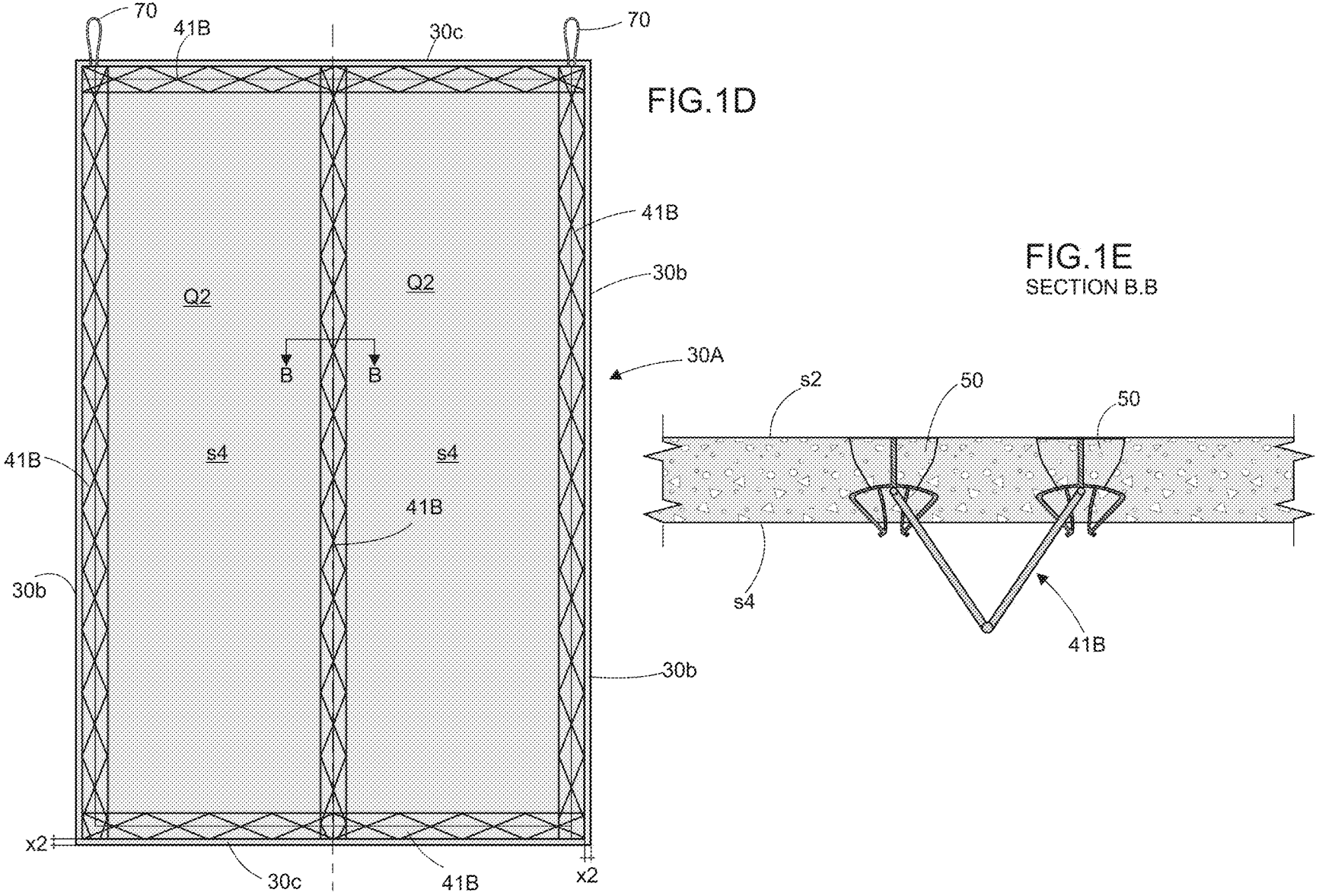
FIG. 1D shows a front view of the complementary panel that composes the structural wall.
FIG. 1E shows a cross sectional view of the panel taken along line BB of FIG. 1D.
Figure 1F:
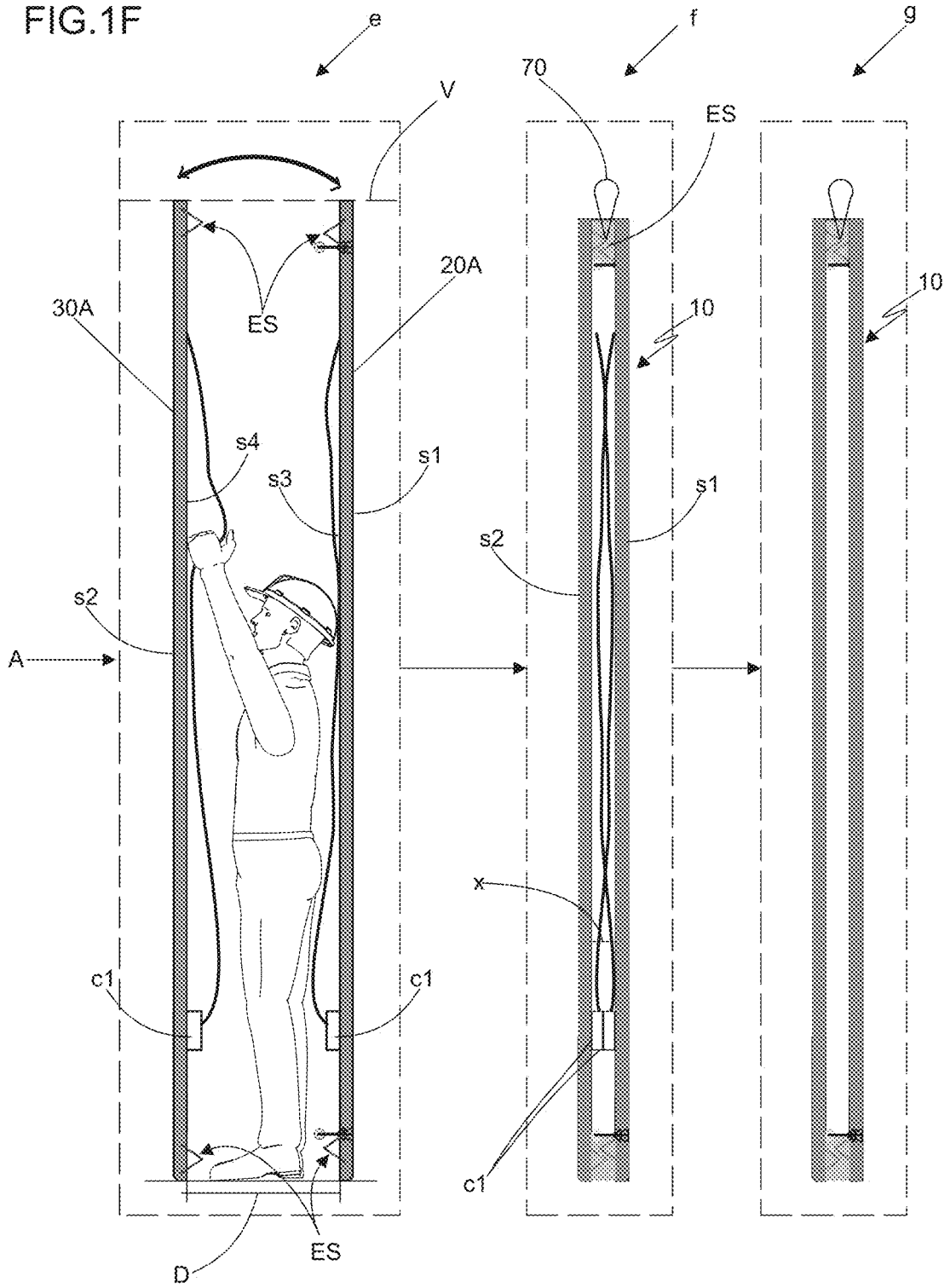
FIG. 1F shows a view of the final assembling steps between the panels that comprise the ventilated wall module.
Figure 1G:
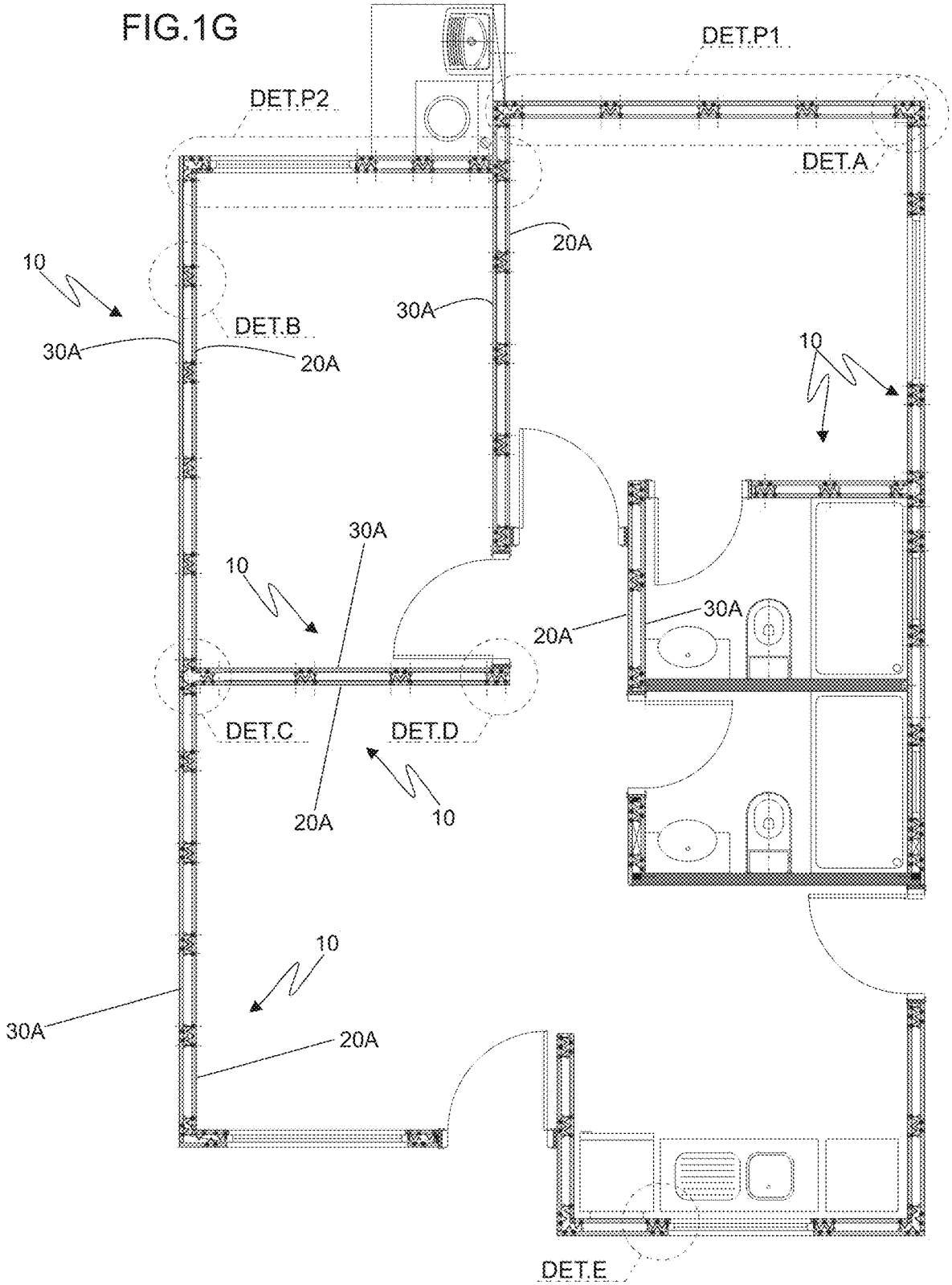
FIG. 1G shows a ground-plan view of the application of ventilated wall modules.
Figure 4:
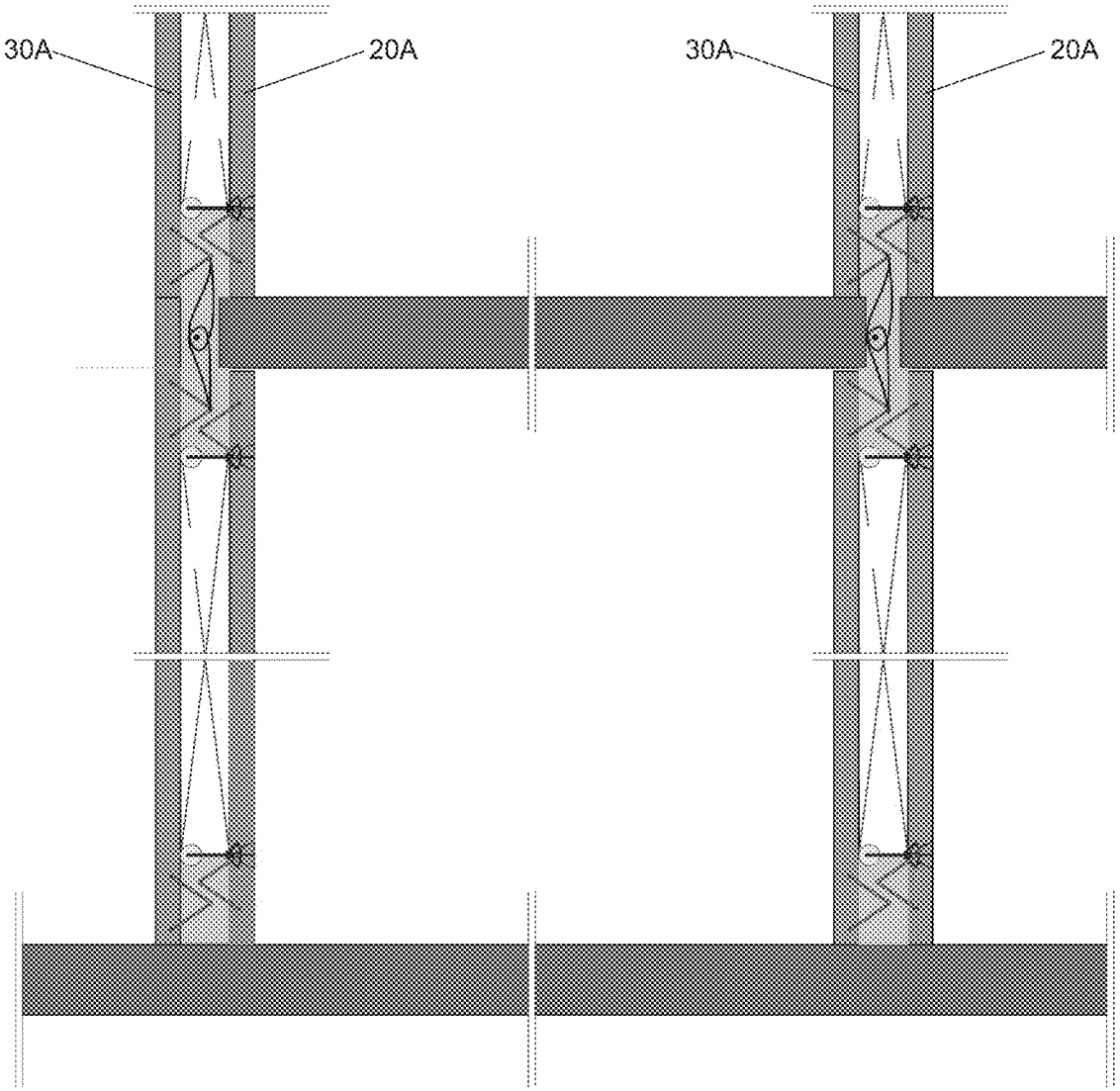
FIG. 4 shows a C.C section view illustrating the slab assembly.
Figure 5:
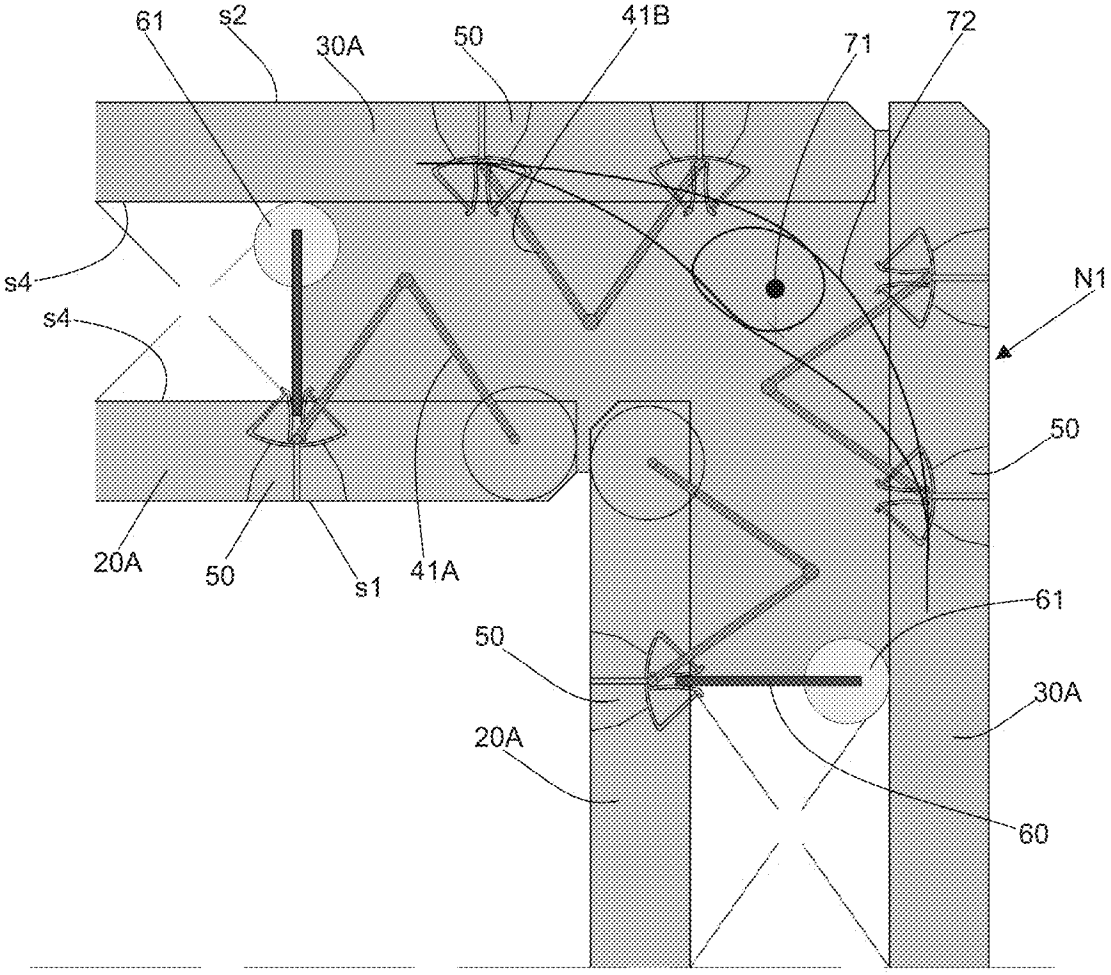
FIG. 5 shows an enlarged detail 'A' of the solidarization element in the form of corner connection between ventilated wall modules illustrated in FIG. 1.
Figure 6:
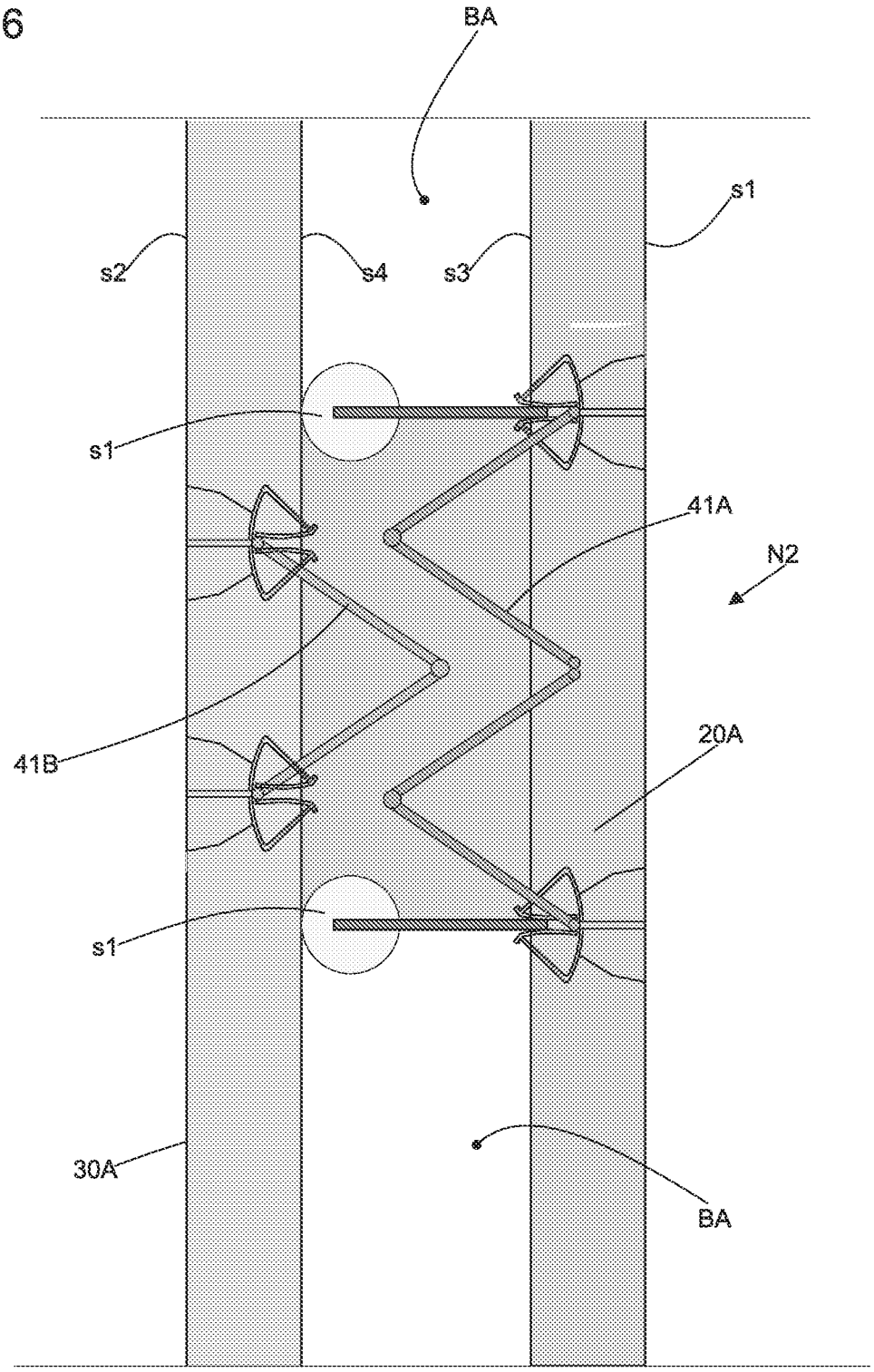
FIG. 6 shows an enlarged detail 'B' of the solidarization element in the form of intermediate rib between ventilated wall modules illustrated in FIG. 1.
Figure 7:
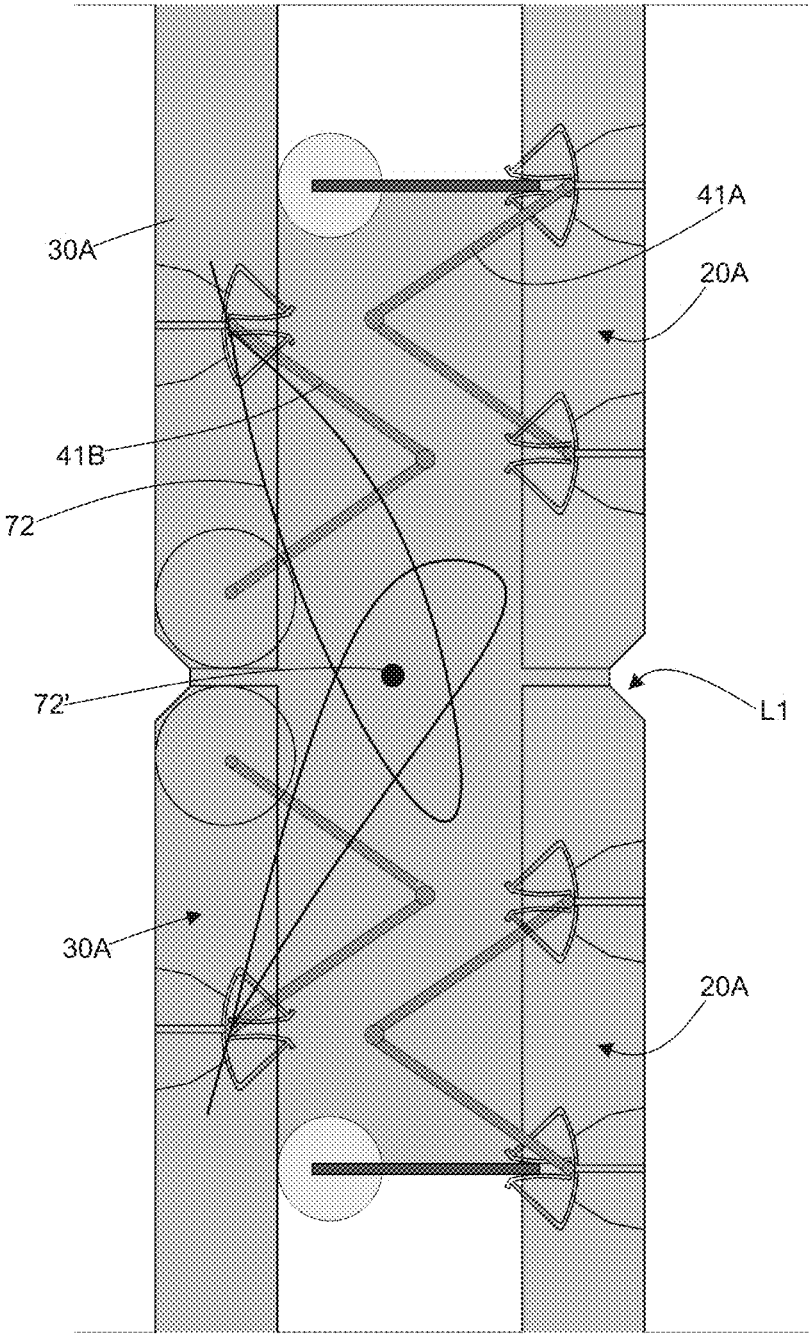
FIG. 7 shows an enlarged detail 'C' of the solidarization element in the form of vertical connection between ventilated wall modules illustrated in FIG. 1.
Figure 8:
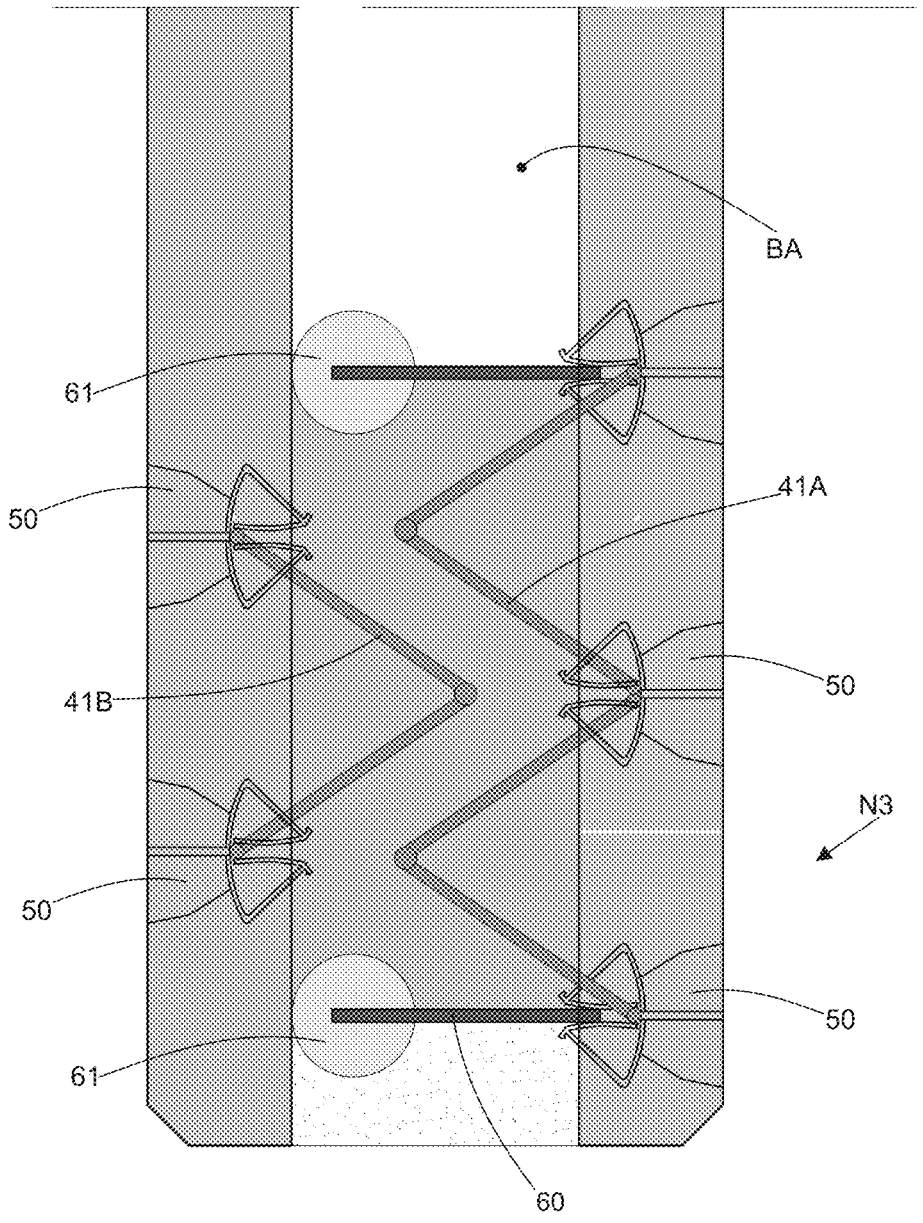
FIG. 8 shows an enlarged detail 'D' of the solidarization element in the form of end ribs of a ventilated wall module illustrated in FIG. 1.

According to the present invention, the mechanized method (MI) developed for the production of the panels (20A) and (30A) includes an industrialized construction system (SC) to obtain each wall module (10) which can be defined by the following sequence:

a) within the area (A1) delimited by the metal shapes (F1) distributed on the metal table (M1) for the composition of the panel (20A) or (30A), the solidarization elements (ES) are prearranged, as well as other components (c1) related to electrical, hydraulic, air conditioning and others belonging to the executive project of the building architecture;

b) the referred area (A1) arranged on the mechanized table (M1) is automatically driven to the plant (U1) and vibrators (V1) for concreting with Fck40 Mpa, in compliance with performance standards;

c) the table (M1) with the concreted area (A1) is led to the curing chamber (C1) for approximately 8 hours, or 12 hours without cure;

d) each panel (20A) and (30A) is removed from the table (M1) in rigid situation and presenting with a finished smooth surface (s1) and (s2) or provided with texture and a surface (s3) and (s4) provided with the respective solidarization elements (ES) (see FIGS. 1B to 1E);

e) panels (20A) and (30A) are placed in a 'clothesline' (V) suspension element (see FIG. 1F), parallel to a distance (D) of 50 cm or other that allows the placement of electrical and hydraulic installations, where applicable;

f) the surfaces (s3) and (s4) of each panel (20A) and (30A) are juxtaposed in such a way as to maintain a spacing (x) delimited by the so-called solidarization elements (ES) of, for example 7 cm, without however restricting such sizing;

g) the surface (s3) and (s4) are grouted in only two points, more precisely where the lifting handles (70) are installed, allowing the transport of the wall module (10) for storage and/or to the work directly, where the other parts of the ventilated wall module will be grouted 'on-site';

Each ventilated wall module (10) therefore comprises a pair of vertical panels (20A) and (30A) industrially produced by the steps of (a) to (g) of the mechanized method (M1) and are made with dimensions identical to each other that may vary in height, width, and thickness as a function of architectural design.

The stages (a) and (d) constitute, more especially, the industrialized construction system (SC) that is summarized in the association of coordination and the compatibility of the projects to be implemented with the pre-installation of complementary components such as electrical boxes (c1) or other necessary elements.

The industrialized construction system (SC) also predicts that with the independent production of each panel (20A)/(30A) the external surfaces (s1) and (s2) are fully smooth prepared for painting or varied coatings or with architectural finishing modeling, for example textures that mimic wood, bricks or others.

The solidarization elements (ES), in a preferred embodiment (see FIGS. 5 to 9) can be defined by a linear frame in metal truss (41A) and (41B) complementary to each other and mounted on the surfaces (s3) and (s4) of the panels (20A)/(30A) in plastic spacers (50), in turn, embedded when concreting the cementitious plates that compose the panels (20A)/(30A). Such spacers (50) are also idealized for the assembly of a series of cementitious plates (60), which have tarucel (61) applied at their free ends.

The peripheral truss assembly (41A) (see FIGS. 1B and 1C) is applied near the vertical (20*b*) and horizontal (20*c*) peripheral edges and at a spacing (x1), while each panel (30A) (see FIGS. 1D and 1E) receive a set of peripheral trusses (41B) applied near the vertical (30*b*) and horizontal (30*c*) peripheral edges in a spacing (x2) relative to said peripheral edges (30*b*) and (30*c*).

Other complementary solidarization elements (ES) are formed by horizontal steel bars (71), steel cables (72) and vertical steel bars (72') and the distance between them configures a preform of embedded beams and columns.

In a preferred embodiment, said panel (20A) has, on surface (s3), the assembly of truss pairs (41A) arranged parallel and juxtaposed near the vertical center (E1) of said panel. Flanking the inner face of each truss (41A) mounted on the surface (s3) are installed on perpendicular manner to the plane of the panel (20A) and respective plastic spacers (50), a series of cementitious plates (60), in which they have tarucel (61) applied at their free ends delimiting quadrangular areas (Q1).

Each panel (30A), in turn, comprises a plate which, on one of the surfaces (s4), receives a set of peripheral trusses (41B) applied close to the vertical (30*b*) and horizontal (30*c*) peripheral edges. The peripheral truss (41B) of the panel (30A) is installed at a spacing (x2) in relation to the aforementioned peripheral edges (30*b*) and (30*c*). The frames formed by the set of trusses (41B) delimit quadrangular areas (Q2) on the surface (s4) of the panel (30A).

The joint of the quadrangular areas (Q1) and (Q2) also delimit air pockets (BA) for thermal comfort and low humidity rate.

The solidarization between the panels (20A) and (30A) by the elements (ES) configure joining ribs between the panels (20A) and (30A) that can be defined as: i) corner connection (N1); ii) intermediate rib (N2); iii) vertical connection (L1); iv) end rib (N3); and v) rabbet for frames (R1).

Figure 9:
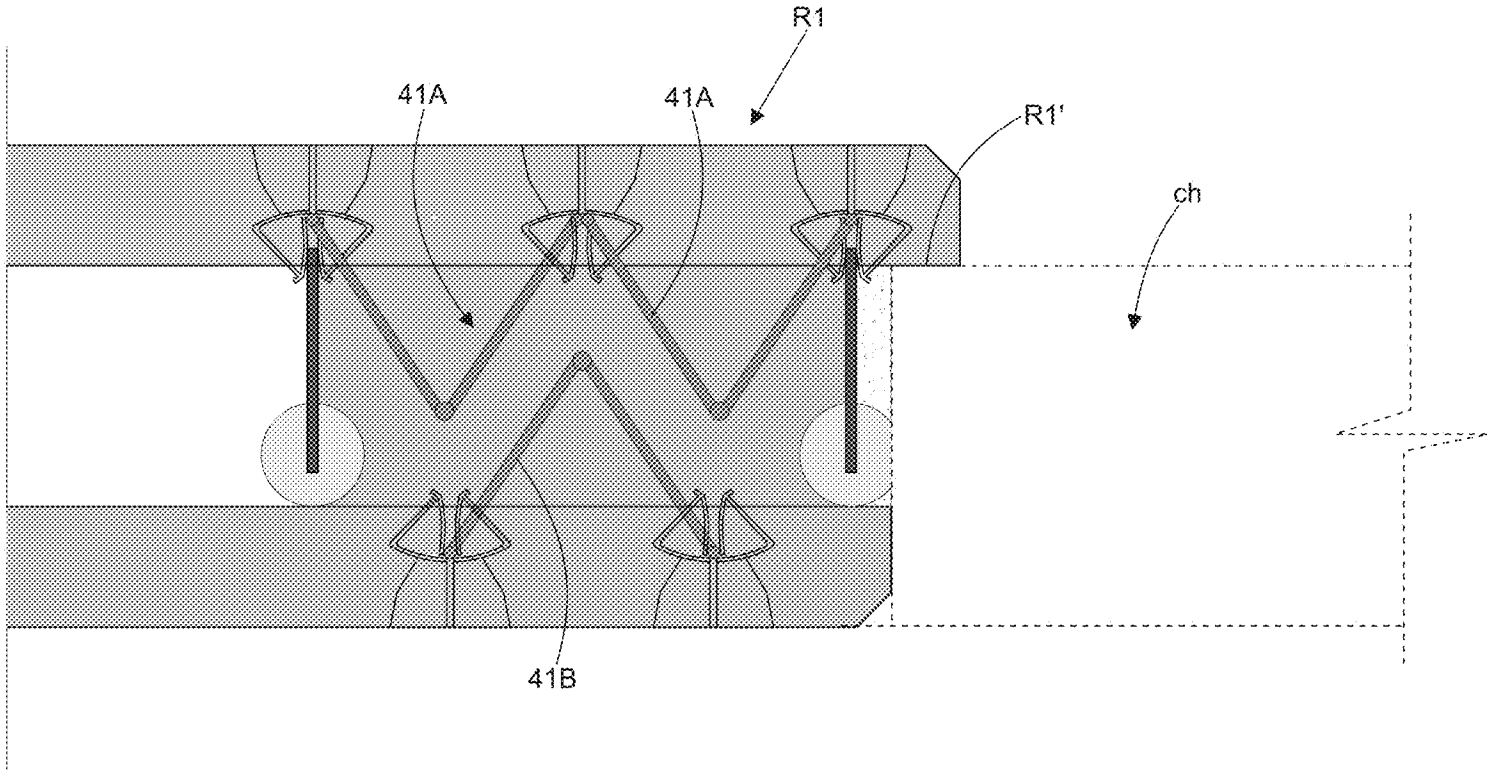
FIG. 9 shows an enlarged detail 'E' of the solidarization element by composing rabbet to a frame of a ventilated wall module illustrated in FIG. 1.

The joining rib (R1) comprises a peripheral frame (R1') for supporting various window frames (ch) (see FIG. 9).

It is certain that when the present invention is put into practice, modifications may be introduced with regard to certain details of construction and form, without this implying a deviation from the fundamental principles that are clearly substantiated in the claiming framework, it being understood that the terminology used did not have the purpose of limitation.

The invention claimed is:

1. A ventilated wall module (10) for buildings using prefabricated parts, the wall module (10) comprising:

first and second panels (20A) and (30A) and multiple truss-shaped solidification elements (ES), the first and second panels (20A) and (20B) each comprising of a cement-based slab with respective inner surfaces (s3) and (s4), vertical peripheral edges (20*b*) and (30*b*), and horizontal peripheral edges (20*c*) and (30*c*), wherein the first and second panels (20A) and (30A) and the multiple truss-shaped solidification elements (ES) are produced by a mechanized method (M1) and, wherein:

the multiple truss-shaped solidification elements (ES), in the form of first and second sets of linear, peripheral, metal trusses (41A) and (41B), are mounted on respective inner surfaces (s3) and (s4) of the panels (20A)/(30A) in plastic spacers (50) embedded in the concreting of the cement-based slabs that compose the panels (20A)/(30A);

each spacer (50) of the first panel (20A) also receives of a cement-based plate (60) provided, at a free end of each cement-based plate (60), with foam (61) to abut the inner surface (s4) of the second panel (30A); the first set of peripheral trusses (41A) is applied close to the vertical (20*b*) and horizontal (20*c*) peripheral edges of the first panel (20A) and in a spacing (x1), whereas the second panel (30A) receives the second set of peripheral trusses (41B) applied next to the vertical (30*b*) and horizontal (30*c*) peripheral edges of the second panel (30A) in a spacing (x2) compared to the aforementioned peripheral edges (30*b*) and (30*c*) of the second panel (30A);

concreting takes place in areas of the multiple truss-shaped solidification elements (ES) delimited by respective cement-based plates with foam, forming a pre-shape of embedded beams and columns, the first and second plates (20A)/(30A) delimit quadrangular areas (Q1) and (Q2) without concreting, forming air pockets (BA) bounded by the embedded beams and columns;

wherein horizontal steel bars (71), steel cables (72) and vertical steel bars (72') are also provided within respective areas delimited by respective cement-based plates (60) with foam to reinforce and complement the solidification between the plates (20A)/(30A) in such areas.

2. The ventilated wall module according to claim 1, wherein the solidarization between the panels (20A) and (30A) by the multiple truss-shaped solidification elements (ES) configure joining ribs between the panels (20A) and (30A) that can be defined as a: i) corner connection (N1); ii) intermediate rib (N2); iii) vertical connection (L1); iv) end rib (N3); and v) rabbet for frames (R1), in which, in turn, comprises a peripheral frame (R1') for supporting various window frames (ch).

* * * * *